US009001626B1

(12) United States Patent
Olen et al.

(10) Patent No.: US 9,001,626 B1
(45) Date of Patent: Apr. 7, 2015

(54) PIEZOELECTRIC ACCELERATION TIMER

(75) Inventors: Vadim Olen, Cedar Rapids, IA (US); Anders P. Walker, Marion, IA (US); Adrian A. Hill, Cedar Rapids, IA (US); Michael C. Meholensky, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 326 days.

(21) Appl. No.: 13/046,121

(22) Filed: Mar. 11, 2011

(51) Int. Cl.
*G04F 8/00* (2006.01)
*G04F 8/02* (2006.01)

(52) U.S. Cl.
CPC ..... *G04F 8/02* (2013.01)

(58) Field of Classification Search
USPC ..... 368/107–109; 73/504.12; 310/339
See application file for complete search history.

(56) References Cited

U.S. PATENT DOCUMENTS 3,808,975 A * 5/1974 Stutzle et al. ..... 102/210
3,850,102 A * 11/1974 Morrow ..... 102/210
3,952,660 A * 4/1976 Davis et al. ..... 102/207
5,269,223 A * 12/1993 Mattsson et al. ..... 102/210
8,042,469 B2 * 10/2011 Rastegar et al. ..... 102/210
2002/0069702 A1 * 6/2002 Tabota ..... 73/504.12
2008/0036307 A1 * 2/2008 Lu et al. ..... 310/15
2009/0160294 A1 * 6/2009 Rastegar et al. ..... 310/339
2010/0271147 A1 * 10/2010 Leibman ..... 331/160
2011/0011172 A1 * 1/2011 Schreiner et al. ..... 73/146.3

* cited by examiner

*Primary Examiner* — Sean Kayes
(74) *Attorney, Agent, or Firm* — Angel N. Gerdzhikov; Donna P. Suchy; Daniel M. Barbieri

(57) ABSTRACT

A timer for measuring a time lapsed during an acceleration is disclosed. The timer may include a piezoelectric sensor, an energy storage device and a measurement module. The piezoelectric sensor includes a piezoelectric material for generating an electric potential in response to the acceleration. The energy storage device is electrically coupled to the piezoelectric sensor and is configured for receiving the electric potential generated by the piezoelectric sensor. The measurement module is electrically coupled to the energy storage device. The measurement module measures the electric potential received at the energy storage device and determines the time lapsed during the acceleration based on the electric potential received at the energy storage device.

20 Claims, 3 Drawing Sheets

PIEZOELECTRIC ACCELERATION TIMER

TECHNICAL FIELD

The present disclosure relates generally to timing devices and more particularly to a timer for measuring a time lapsed during an acceleration event.

BACKGROUND

High accuracy clocks and frequency standards may be required in various products such as Global Positioning System (GPS) devices, high frequency devices, tracking systems or the like. Such products may utilize oscillators (e.g., crystal oscillators) to create signals with precise frequencies to keep track of time and to stabilize frequencies for transmitters and receivers of the products. When these products are utilized in high acceleration and/or vibration environments (e.g., as a part of a guided artillery shell), the crystal oscillators may shift in frequency and become inaccurate or even nonfunctional.

Various attempts have been made to improve the oscillator accuracies during high accelerations, including attempts to decrease G-sensitivities in oscillator circuits and mechanical resonators. For example, the oscillator crystals may be mechanically reinforced to survive high acceleration events. In another example, low G-sensitivity oscillators such as MEMS oscillators may be utilized. However, such attempts introduce additional expenses while only providing marginal improvements due to complex crystal and resonator dynamics.

SUMMARY

The present disclosure is directed to a timer for measuring time lapsed during high accelerations of a vehicle. The time measured may be utilized for improving oscillator accuracies onboard the vehicle. The timer may include a piezoelectric sensor, an energy storage device and a measurement module. The piezoelectric sensor includes a piezoelectric material for generating an electric potential in response to the acceleration. The energy storage device is electrically coupled to the piezoelectric sensor and is configured for receiving the electric potential generated by the piezoelectric sensor. The measurement module is electrically coupled to the energy storage device. The measurement module measures the electric potential received at the energy storage device and determines the time lapsed during the acceleration based on the electric potential received at the energy storage device.

A further embodiment of the present disclosure is directed to a method for measuring a time lapsed during an acceleration. The method may comprise generating an electric potential in response to a deflection of a piezoelectric sensor during the acceleration; charging an energy storage device utilizing the generated electric potential; measuring an amount of electric potential stored in the energy storage device; and determining the time lapsed during the acceleration based on the amount of the electric potential stored in the energy storage device.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION

Reference will now be made in detail to exemplary embodiments of the disclosure, examples of which are illustrated in the accompanying drawings.

Figure 1:
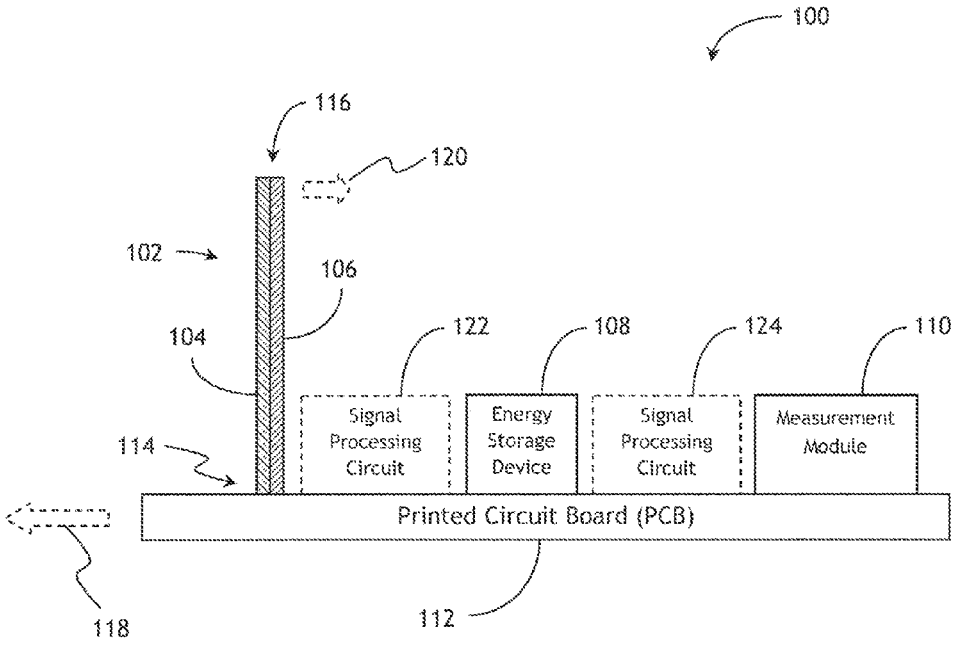
FIG. 1 is a block diagram illustrating a timer for measuring a time lapsed during an acceleration.

Referring to FIG. 1, a block diagram illustrating a timer 100 for measuring a time lapsed during an acceleration event is shown. The timer 100 may include a piezoelectric sensor 102, an energy storage device 108 and a measurement module 110. The piezoelectric sensor 102 is electrically coupled to the energy storage device 108 and the energy storage device 108 is electrically coupled to the measurement module 110. In one embodiment, a printed circuit board (PCB) 112 may be utilized to provide support and electrical connections for the piezoelectric sensor 102, the energy storage device 108 and the measurement module 110. It is understood, however, that various other arrangements may be utilized to provide support without departing from the spirit and scope of the present disclosure.

The piezoelectric sensor 102 may include a stationary portion 114 and a floating portion 116. The stationary portion 114 is securely mounted to a support member (the PCB 112 in the example depicted in FIG. 1) while the floating portion 116 is not firmly connected to any external devices. This allows deflections to occur at the floating portion 116 of the piezoelectric sensor 102 during accelerations or vibrations. Stress applied to the piezoelectric sensor 102 due to such deflections may cause the piezoelectric sensor 102 to generate electric potentials. The generated electric potentials may charge the energy storage device 108, and the measurement module 110 may determine the duration of the accelerations or vibrations based on the amount of electric potentials received at the energy storage device 108.

It is understood that the orientation of the piezoelectric sensor 102 with respect to the support member as depicted in FIG. 1 is merely exemplary. The piezoelectric sensor 102 may be attached to the support member in any orientation as long as the attached piezoelectric sensor 102 defines a floating portion 116 that is responsive to accelerations and/or vibrations.

The timer 100 in accordance with the present disclosure may be mounted on a vehicle and utilized for measuring a time lapsed during an acceleration of the vehicle. The vehicle may be any mechanical means of conveyance or transport, which may include, but is not limited to, an automobile, a boat, a train, an aircraft, a missile, an artillery shell, a projectile or the like. When a vehicle (e.g., an artillery shell) accelerates at a rate above a certain threshold, timing devices such as oscillators onboard the vehicle may shift in frequency and become inaccurate or nonfunctional. The timer 100 in accordance with the present disclosure may therefore be placed on the vehicle to measure the duration of such a high acceleration event. The duration of the high acceleration event (i.e., the duration that is unaccounted for by the oscillator) may then be correctly accounted for, improving the clock accuracy for the vehicle.

It is contemplated that when a vehicle starts to accelerate in one direction 118, the floating portion 116 of the piezoelectric sensor 102 may be deflected towards an opposing direction 120. This deflection may introduce stress to the piezoelectric sensor 102, causing the piezoelectric sensor 102 to generate electric potentials. For a given acceleration event, the amount of deflection (e.g., the displacement at the floating portion 116 or the tip of the piezoelectric sensor 102) may be determined based on the acceleration rate of the vehicle and the physical characteristics (e.g., rigidity and/or thickness) of the piezoelectric sensor 102. Furthermore, the voltage expected to be produced by the piezoelectric sensor 102 may be determined based on its piezoelectric constant and the amount of deflection. For instance, the voltage expected to be produced by the piezoelectric sensor 102 may be determined as follows:

$$V = \Delta x \times \frac{t^2}{0.75 \times d_{31} \times l^2}$$

where Δx is the deflection at the tip of the piezoelectric sensor 102 for the given acceleration event; t is the thickness of the piezoelectric material in the piezoelectric sensor 102; l is the length of the piezoelectric sensor 102; and $d_{31}$ is the piezoelectric constant of the piezoelectric material utilized in the piezoelectric sensor 102.

The voltage produced by the piezoelectric sensor 102 during the acceleration may be utilized as the supply voltage to charge the energy storage device 108. For instance, the electric potentials may induce a flow of power to the energy storage device 108, and the energy storage device 108 may then store the energy from the power flow. The energy storage device 108 may include any device that is capable of storing the energy from the power flow. Such devices may include capacitors, electrochemical devices (e.g., batteries), inductors or the like.

In general, the longer the energy storage device 108 is being charged, the greater the output voltage of the energy storage device 108 may be. More specifically, for a given supply voltage (i.e., the voltage expected to be produced by the piezoelectric sensor 102 during the acceleration), the relationship (may also be referred to as charging characteristics) between the charge time of the energy storage device 108 and its corresponding output voltage may be predetermined and/or previously known. Therefore, by measuring the output voltage of the energy storage device 108, its corresponding charge time may also be determined.

The measurement module 110 may be utilized to measure the voltage on the energy storage device 108 once the piezoelectric sensor 102 stops generating electric potentials (i.e., when the acceleration ends). For example, the measurement module 110 may utilize an analog-to-digital converter (ADC) to monitor and measure the voltage on the energy storage device 108. The measurement module 110 may subsequently determine the charge time of the energy storage device 108 based on the voltage on the energy storage device 108 and the charging characteristics of the energy storage device 108. For example, the charging curve of the energy storage device 108 may be utilized to describe the charging characteristics of the energy storage device 108. Based on the charging curve, the measurement module 110 may accurately determine the amount of time required to charge the energy storage device 108 in order for the energy storage device 108 to reach the measured voltage. It is noted that since the charge time of the energy storage device 108 coincide with the duration of the acceleration, the determined charge time may therefore represent the duration of the acceleration.

It is contemplated that timers in accordance with the present disclosure may be optimized for different types of vehicles. For example, different types of artillery shells (or other types of vehicles) may accelerate at different rates. Therefore, the piezoelectric sensors may be configured differently for different acceleration environments. For instance, piezoelectric sensors with certain rigidities may be utilized in high acceleration environments while less rigid piezoelectric sensors may provide enhanced sensitivities in other environments. The rigidities of the piezoelectric sensors may be a function of the specific dimensions of the sensor and/or the piezoelectric materials utilized. It is understood that specific configurations of the piezoelectric sensors may vary for specific types of vehicles without departing from the spirit and scope of the present disclosure.

In one embodiment, the piezoelectric sensor 102 includes multiple sensor layers 104 and 106 oriented substantially parallel with respect to each other. The sensor layers 104 and 106 are made of piezoelectric materials and are polarized in opposite directions with conductive contacts on both sides. Each of the sensor layers 104 and 106 are configured as a rectangular-shaped cantilever plate having a stationary portion 114 fixedly attached to the support member (the PCB 112 in the example depicted in FIG. 1). Each rectangular-shaped plate may have a length of approximately 2 cm, a width of approximately 0.5 cm and a thickness of less than approximately 1 mm. The rectangular-shaped plates may be laminated together utilizing a thin layer of adhesive to form the piezoelectric sensor 102.

Polyvinylidene Fluoride (PVDF) may be utilized as the piezoelectric material for sensor layers 104 and 106. PVDF provides very high piezoelectric constant and high mechanical compliance, making it a suitable material for forming piezoelectric sensors. It is contemplated, however, that various other piezoelectric materials such as lead titanate (PbTiOx), lead zirconium titanate (PZT), lead magnesium niobate-lead titanate (PMN-PT) or the like may also be utilized without departing from the spirit and scope of the present disclosure.

It is also contemplated that the timer 100 in accordance with the present disclosure may further include one or more signal processing circuits. For example, a first signal processing circuit 122 may be utilized to interface between the piezoelectric sensor 102 and the energy storage device 108. The first signal processing circuit 122 may be utilized as a filter, for example, to filter out noises that may be associated with the output signals of the piezoelectric sensor 102. Similarly, a second signal processing circuit 124 may be utilized to interface between the energy storage device 108 and the measurement module 110. The second signal processing circuit 124 may be utilized as an amplifier, for example, to amplify the output of the energy storage device 108 if the output is deemed too low for measurement purposes. It is understood that the functionalities provided by such signal processing circuits are not limited to filtering and/or amplifying. Various types of signal processing may be utilized for conditioning, buffering, regulating, smoothing as well as other purposes without departing from the spirit and scope of the present disclosure. It is also understood, however, that the utilization of such signal processing circuits is optional.

Figure 2:
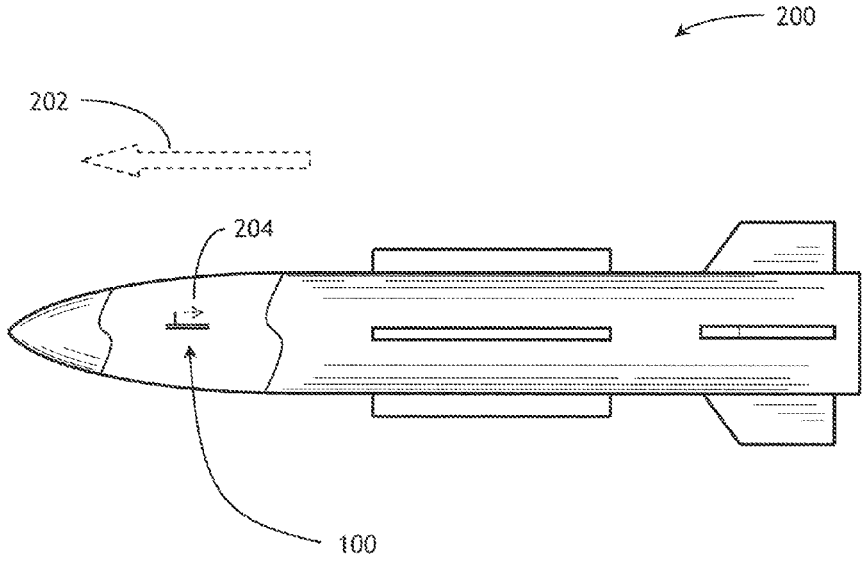
FIG. 2 is a partial cross-sectional side view depicting a timer housed in an exemplary artillery shell.

Referring to FIG. 2, a partial cross-sectional side view (not to scale) depicting the timer 100 housed in an exemplary artillery shell 200 is shown. The timer 100 may be utilized as a standalone device that is in communication with the guidance system of the artillery shell 200. Alternatively, the timer 100 may be integrated within the guidance system (e.g., the GPS circuitry) of the artillery shell 200. The artillery shell 200 may start to accelerate in direction 202 at a high rate after the artillery shell 200 is fired, causing the piezoelectric sensor of the timer 100 to deflect towards an opposing direction 204. This deflection may introduce stress to the piezoelectric sensor and cause the piezoelectric sensor to generate electric potentials. The timer 100 may determine the duration of the high acceleration based on the amount of the electric potentials as previously described, allowing the duration of the high acceleration to be correctly accounted for.

It is understood that the timer 100 and the artillery shell 200 shown in FIG. 2 are merely exemplary. The timer 100 in accordance with the present disclosure may be utilized in artillery shells of various sizes. In addition, the size of the piezoelectric sensor may also vary for specific implementations. It is also understood that the timer in accordance with the present disclosure may be utilized in various other types of vehicles such as automobiles, boats, trains, aircrafts, missiles, rockets, projectiles or the like without departing from the spirit and scope of the present disclosure.

Figure 3:
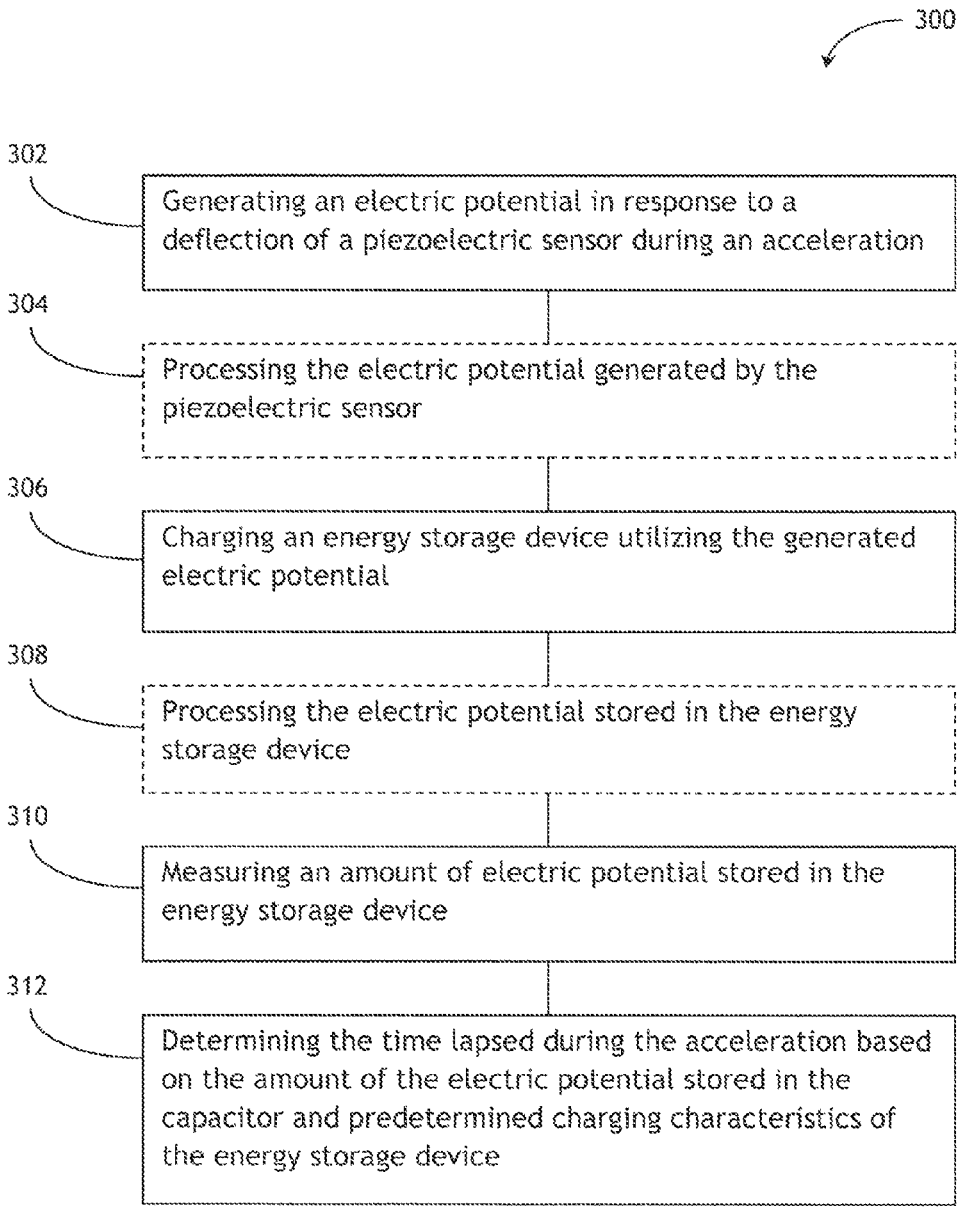
FIG. 3 is a flow diagram illustrating a method for measuring a time lapsed during an acceleration.

Referring to FIG. 3, a method 300 for measuring a time lapsed during an acceleration is shown. As previously described, an acceleration event may deflect a piezoelectric sensor, and the stress applied to the piezoelectric sensor due to such deflections may cause the piezoelectric sensor to generate electric potentials in step 302. In certain configurations, an optional signal processing circuit may be utilized in step 304 to process (e.g., filter and/or amplify) the electric potentials generated by the piezoelectric sensor.

The electric potentials generated by the piezoelectric sensor may be utilized to charge an energy storage device in step 306. The energy storage device may include a capacitor, an electrochemical device (e.g., a battery), an inductor or the like. Another optional signal processing circuit may be utilized in step 308 to process the electric potentials stored in the energy storage device. Step 310 may measure the amount of electric potential stored in the energy storage device at the end of the acceleration, and step 312 may determine the time lapsed during the acceleration based on the amount of the electric potential stored in the energy storage device and a charging characteristics of the energy storage device (as previously described). In one embodiment, the end of the acceleration may be detected when the piezoelectric sensor ceases to generate electric potentials.

It is contemplated that the timer in accordance with the present disclosure may be utilized in various other environments. For example, the timer may be utilized for measuring time lapsed during a deceleration event or a vibration event without departing from the spirit and scope of the present disclosure.

It is understood that the present disclosure is not limited to any underlying implementing technology. The present disclosure may be implemented utilizing any combination of software and hardware technology. The present disclosure may be implemented using a variety of technologies without departing from the scope and spirit of the invention or without sacrificing all of its material advantages.

It is understood that the specific order or hierarchy of steps in the processes disclosed is an example of exemplary approaches. Based upon design preferences, it is understood that the specific order or hierarchy of steps in the processes may be rearranged while remaining within the scope of the present invention. The accompanying method claims present elements of the various steps in a sample order, and are not meant to be limited to the specific order or hierarchy presented.

It is believed that the present disclosure and many of its attendant advantages will be understood by the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An apparatus, comprising:

a piezoelectric sensor, the piezoelectric sensor comprising a piezoelectric material for generating an electric potential in response to vibration;

an energy storage device, the energy storage device electrically coupled to the piezoelectric sensor, the energy storage device configured for receiving the electric potential generated by the piezoelectric sensor; and a measurement module, the measurement module electrically coupled to the energy storage device, the measurement module configured for measuring the electric potential received at the energy storage device, the measurement module further configured for determining a time lapsed during the vibration based on: the electric potential received at the energy storage device, and predetermined charging characteristics of the energy storage device for a predetermined charging voltage expected to be produced by the piezoelectric sensor in response to the vibration.

2. The apparatus of claim 1, wherein the measurement module is configured for measuring a voltage on the energy storage device.

3. The apparatus of claim 2, wherein the time lapsed during the vibration is determined based on the measured voltage on the energy storage device and the predetermined charging characteristics of the energy storage device, and the predetermined charging characteristics of the energy storage device establishes a relationship between a charge time of the energy storage device and an output voltage of the energy storage device.

4. The apparatus of claim 1, wherein the piezoelectric sensor defines a stationary portion for mounting to a support member on a vehicle, and a floating portion for being responsive to vibration of the vehicle.

5. The apparatus of claim 1, wherein the piezoelectric sensor comprises at least two sensor layers oriented substantially parallel with respect to each other.

6. The apparatus of claim 1, further comprising:

a first signal processing circuit, the first signal processing circuit electrically coupled between the piezoelectric sensor and the energy storage device, the first signal processing circuit configured for processing the electric potential generated by the piezoelectric sensor.

7. The apparatus of claim 1, further comprising:

a second signal processing circuit, the second signal processing circuit electrically coupled between the energy storage device and the measurement module, the second signal processing circuit configured for processing the electric potential stored in the energy storage device.

8. An apparatus for measuring a time lapsed during a vibration, the apparatus comprising:

a piezoelectric sensor, the piezoelectric sensor having at least two sensor layers oriented substantially parallel with respect to each other, at least one of the sensor layers comprises a piezoelectric material for generating an electric potential in response to the vibration;

an energy storage device, the energy storage device electrically coupled to the piezoelectric sensor, the energy storage device configured for receiving the electric potential generated by the piezoelectric sensor; and a measurement module, the measurement module electrically coupled to the energy storage device, the measurement module configured for measuring the electric potential received at the energy storage device, the measurement module further configured for determining the time lapsed during the vibration based on: the electric potential received at the energy storage device, and predetermined charging characteristics of the energy storage device for a predetermined charging voltage expected to be produced by the piezoelectric sensor in response to the vibration.

9. The apparatus of claim 8, wherein the measurement module is configured for measuring a voltage on the energy storage device.

10. The apparatus of claim 9, wherein the time lapsed during the vibration is determined based on the measured voltage on the energy storage device and the predetermined charging characteristics of the energy storage device, and the predetermined charging characteristics of the energy storage device establishes a relationship between a charge time of the energy storage device and an output voltage of the energy storage device.

11. The apparatus of claim 8, wherein each of the at least two sensor layers of the piezoelectric sensor is configured as a rectangular-shaped cantilever plate.

12. The apparatus of claim 8, further comprising:

a first signal processing circuit, the first signal processing circuit electrically coupled between the piezoelectric sensor and the energy storage device, the first signal processing circuit configured for processing the electric potential generated by the piezoelectric sensor.

13. The apparatus of claim 8, further comprising:

a second signal processing circuit, the second signal processing circuit electrically coupled between the energy storage device and the measurement module, the second signal processing circuit configured for processing the electric potential stored in the energy storage device.

14. The apparatus of claim 8, wherein the piezoelectric material comprises Polyvinylidene Fluoride (PVDF).

15. A method for measuring a time lapsed during a vibration, the method comprising:

generating an electric potential in response to a deflection of a piezoelectric sensor during the vibration;

charging an energy storage device utilizing the generated electric potential;

measuring an amount of electric potential stored in the energy storage device; and determining the time lapsed during the vibration based on: the amount of the electric potential stored in the energy storage device, and predetermined charging characteristics of the energy storage device for a predetermined charging voltage expected to be produced by the piezoelectric sensor in response to the vibration.

16. The method of claim 15, wherein the amount of the electric potential stored in the energy storage device is measured as a voltage on the energy storage device.

17. The method of claim 16, wherein the time lapsed during the vibration is determined based on the measured voltage on the energy storage device and the predetermined charging characteristics of the energy storage device, and the predetermined charging characteristics of the energy storage device establishes a relationship between a charge time of the energy storage device and an output voltage of the energy storage device.

18. The method of claim 15, further comprising:

processing the electric potential generated by the piezoelectric sensor prior to charging the energy storage device utilizing the generated electric potential.

19. The method of claim 15, further comprising:

processing the electric potential stored in the energy storage device prior to measuring the amount of electric potential stored in the energy storage device.

20. The method of claim 15, further comprising:

detecting an end of the vibration, the end of the vibration is detected when the piezoelectric sensor ceases to generate the electric potential, wherein the amount of electric potential stored in the energy storage device is measured subsequent to detecting the end of the vibration.

* * * * *